US007329995B2

(12) United States Patent
Chen

(10) Patent No.: US 7,329,995 B2
(45) Date of Patent: Feb. 12, 2008

(54) SERIAL LAMP SET HAVING SECURITY WARNING FUNCTIONS

(75) Inventor: Johnny Chen, Hsin-chu (TW)

(73) Assignee: Willis Electric Co., Ltd., Hsin-chu (TW)

( * ) Notice: Subject to any disclaimer, the term of this patent is extended or adjusted under 35 U.S.C. 154(b) by 0 days.

(21) Appl. No.: 11/269,186

(22) Filed: Nov. 8, 2005

(65) Prior Publication Data

US 2007/0103097 A1 May 10, 2007

(51) Int. Cl.
*H01J 1/60* (2006.01)
*H05B 37/00* (2006.01)
*H05B 41/00* (2006.01)

(52) U.S. Cl. ..... 315/129; 315/312; 321/185 S

(58) Field of Classification Search ..... 315/56, 315/120–123, 127, 129, 130–133, 312, 185 S; 340/955, 463, 288, 292, 815.45, 815.43, 340/815.65

See application file for complete search history.

(56) References Cited

U.S. PATENT DOCUMENTS 6,086,220 A * 7/2000 Lash et al. ..... 362/244
6,204,770 B1 * 3/2001 Johnson ..... 340/660
6,719,443 B2 * 4/2004 Gutstein et al. ..... 362/392
6,858,986 B2 * 2/2005 Monk ..... 315/76
7,038,398 B1 * 5/2006 Lys et al. ..... 315/291
7,132,804 B2 * 11/2006 Lys et al. ..... 315/292
7,145,343 B2 * 12/2006 Frederick et al. ..... 324/414

* cited by examiner

*Primary Examiner*—Shih-Chao Chen
*Assistant Examiner*—Minh Dieu A
(74) *Attorney, Agent, or Firm*—McGlew and Tuttle, P.C.

(57) ABSTRACT

A serial lamp set having security warning functions comprising at least one serial lamp set unit composed of a plurality of light emitting elements, insulated electric wires, and power source connector; at least one IC set being connected in the serial lamp set for receiving the signal of electric power, generating pre-determined functions, having set limitation values of electric properties of the serial lamp set, emitting signals, such as a warning signal, and having set security warning functions. After the power connector is connected to the power source, a preset security warning signal shall be released at the time when the load of the serial lamp set is over the preset limitation value of an electric property.

16 Claims, 4 Drawing Sheets

SERIAL LAMP SET HAVING SECURITY WARNING FUNCTIONS

FIELD OF THE INVENTION

The present invention relates to a serial lamp set having security warning functions, especially to a serial lamp set formed by a serial lamp set unit or a plurality of serial lamp set units. If the load of a serial lamp set unit is over the preset limitation value of an electric property, a preset security warning signal shall be released.

BACKGROUND OF THE INVENTION

The conventional light emitting apparatus are basically composed of light emitting elements such as lamps, LEDs to connect electric conducting wires with power source and develop the functions of illumination or decoration. Generally, the light emitting apparatus is formed by connecting a plurality of light emitting elements in series or in parallel or in series-parallel as a serial lamp, after the power source is connected and the current flows into the light emitting apparatus, variable kinds of flash lights are then generated as a decoration in celebration, business advertisement and other special fields.

However, the number of light emitting elements of said conventional serial lamp set shall be affected by the articles used for hanging the serial lamp set by people. For example, the Christmas trees may be as high as several meters to several floors. It is not only lightened for a long time, when the light emitting elements of light emitting apparatus formed by a plurality of serial connected lamps are lightened simultaneously, the loads of electric wires are very high. And, the temperature increasing occurred due to longtime lightening of Christmas lamps always accidentally cause the burning of Christmas trees and the fires. Consequently, a thermo-alarm for Christmas tree is then created in order to prevent the accidents. It is a unique article to be hanged onto Christmas tree alone, and mainly includes a thermo-sensor for detecting abnormal temperature vibrations, signals happened around it, and amplify the signal by an amplifier, then trigger an audio circuit to generate visible or audible signals. However, because its electric power is generated by the battery installed inside it, when the electric power is not sufficient for operating electric circuit or the user forgets to change new batteries, its functions of warning will be lost, and the accidents still may be occurred.

Besides, the method of detecting the temperature outside Christmas tree and then releasing alarm signals not only will decrease the accuracy of sensor due to environmental conditions, but also may not generate visible or audible signals when the load of electric wire is over a pre-determined value. This is also a disadvantage of conventional apparatus.

SUMMARY OF THE INVENTION

Accordingly, the primary object of the present invention is to provide a serial lamp set having security warning functions, when the current load of the power source connected by the power source connector is over the preset limitation value of an electric property, a preset security signal will be emitted.

According to the serial lamp set having security warning functions of the present invention, the construction for detecting whether the load of serial lamp set is over the preset limitation of an electric property contains an integrated circuit (IC) set installed in the electric connector of power source, the integrated circuit (IC) set has the functions of receiving the signal of electric power, generating pre-determined functions, having set limitation values of electric properties, emitting signals, such as a warning signal, and having set security warning functions, so as to provide basic protection to the serial lamp set.

According to the serial lamp set having security warning functions of present invention, it further provides a plurality of serial lamp set units connected in series, or in parallel or in parallel-series, each of the serial lamp set unit is composed by a plurality of light emitting elements, insulated electric wires, power source receiver and power supply; and a plurality of integrated circuit (IC) sets to be connected in said serial lamp set units, it has the functions of receiving the signal of electric power, generating pre-determined functions, having set limitation values of electric properties, emitting signals, such as a warning signal, and having set security warning functions; by connecting the serial lamp set units with power source, the integrated circuit (IC) sets would receive the total electric properties of the numerous serial lamp set units, and when the total electric properties of the serial lamp set is over the pre-limited value, a warning signal will be released and the signal will be transmitted to each serial lamp set unit and then an alarm signal will be emitted simultaneously by each serial lamp set unit.

According to the serial lamp set having security warning functions of the present invention, it further provides a plurality of serial lamp set units connected in series, or in parallel or in parallel-series, each of the serial lamp set unit is composed by a plurality of light emitting elements, insulated electric wires, power source receiver and power supply; and a plurality of integrated circuit (IC) sets to be connected in said serial lamp sets, it has the functions of receiving the signal of electric power, generating pre-determined functions, having set limitation values of electric properties, emitting signals, such as a warning signal and having set security warning functions; when each of the power supply of said plurality of serial lamp set units is connected to receiver, its signal generator then matches signal sensor all the time; if the first serial lamp set unit connects to power source, its integrated circuit (IC) set would receive the total electric properties of the numerous serial lamp set units, and when the total electric properties of the serial lamp sets is over the pre-limited value, a warning signal will be released and the signal will be transmitted to the signal sensor of the power supply via the signal generator of the power receiver.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
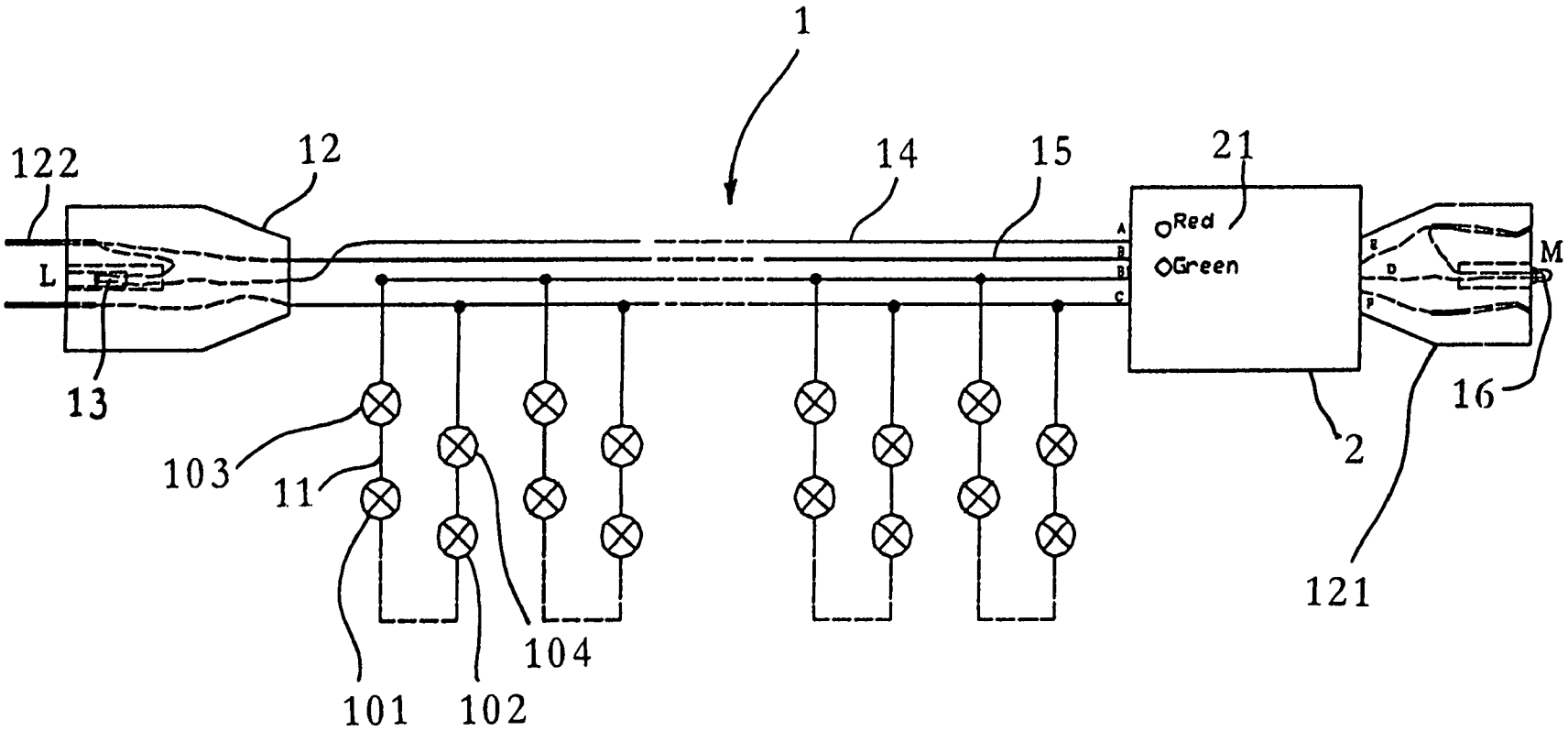
FIG. 1 is a schematic view showing the serial lamp set of present invention.

Referring to the drawings in particular, FIG. 1 of the serial lamp set having security warning functions of present invention, the serial lamp set comprises:

a serial lamp set unit 1, the serial lamp set unit 1 is formed by a serial connected or serial and parallel connected light emitting elements 101, 102, 103, 104, . . . , the light emitting elements 101, 102, 103, 104, . . . are connected by electric insulated wire 11, and a power source connector is installed at one end of the serial lamp 1;

an integrated circuit (IC) set 2 is connected to the electric circuit of the serial lamp set 1; the integrated circuit (IC) set is formed by a plurality of resistors, capacitors, oscillators, light emitting diodes, and comparison amplifiers, etc., it has the functions of receiving the signal of electric power, generating pre-determined functions, having set limitation values of electric properties, emitting signals, such as a warning signal, and having set security warning functions;

the light emitting elements 101, 102, 103, 104, . . . maybe light bubbles or LED lamps, the light emitting elements 101, 102, 103, . . . also can be installed onto kinds of sockets or lamp seats.

The front end of the power connector is a power supply in the form of a plug to be connected to power source. The rear end of the power connector is a power receiver 121. Inside the power supply 12, a signal sensor 13 is installed, the signal sensor 13 connects point "A" of integrated circuit (IC) set 2 by a signal transmitting wire 14, one plugging end 122 of the power supply 12 is connected to point "B" of integrated circuit (IC) set 2 by insulated electric wire 15.

The signal sensor 13 can receive and detect the condition of power source receiving end, then the signal is emitted and transmitted to the IC set 2, after the IC set 2 identify the current load condition, the current load condition will be shown on the housing of the IC set 2; the signal sensor 13 is a CDS photo-sensitive resistor, it is installed inside the power supply 12, such that the interference from outside will be prevented.

The IC set 2 composes a plurality of IC chips, resistors, capacitors, diodes, connection terminals, pc board and insulation housing. On the insulation housing, there is an alarm part 21 including a green LED lamp and a red LED lamp, when the electric alarm signal is emitted, the insulated electric wire will transmit the signal to the rear power source receiver 121, and then display the warning conditions. When the green LED is lightened, it shows that the serial lamp set is in a safe condition, if the red LED is lightened, it shows that the serial lamp set is in an unsafe condition (that is, the load is over preset limitation value of electric property).

The power receiver 121 is installed at the other end of IC set 2 and is formed together with the IC set 2 without connection of insulated electric wire between them. Inside the power receiver 121, there is a signal generator 16. After the power supply 12 is connected with power source, if the load of serial lamp set exceeds the limitation values of electric properties preset in the IC set 2, then a security warning signal will be emitted from the alarm part 21.

Figure 2:
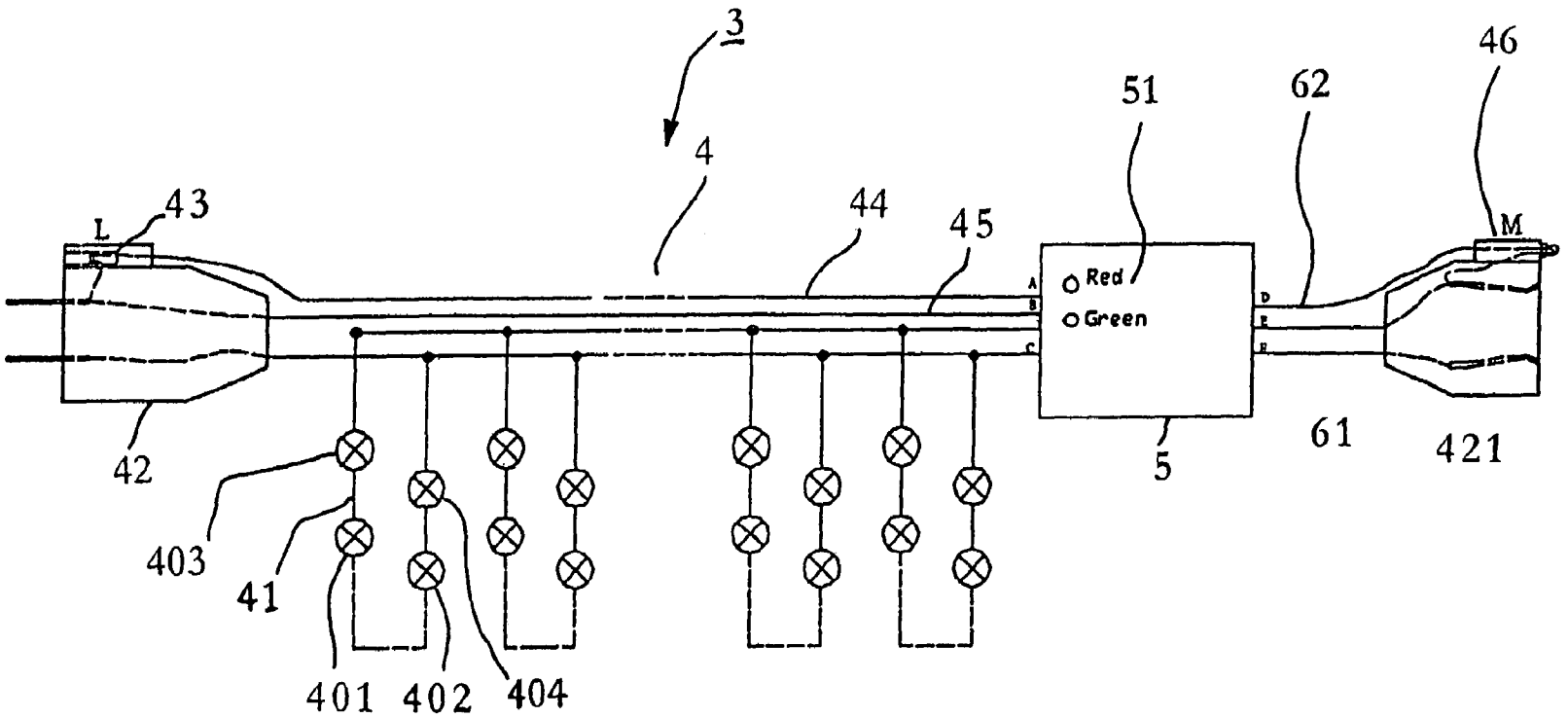
FIG. 2 is a schematic view showing the second embodiment of the serial lamp set of present invention.
Figure 3:
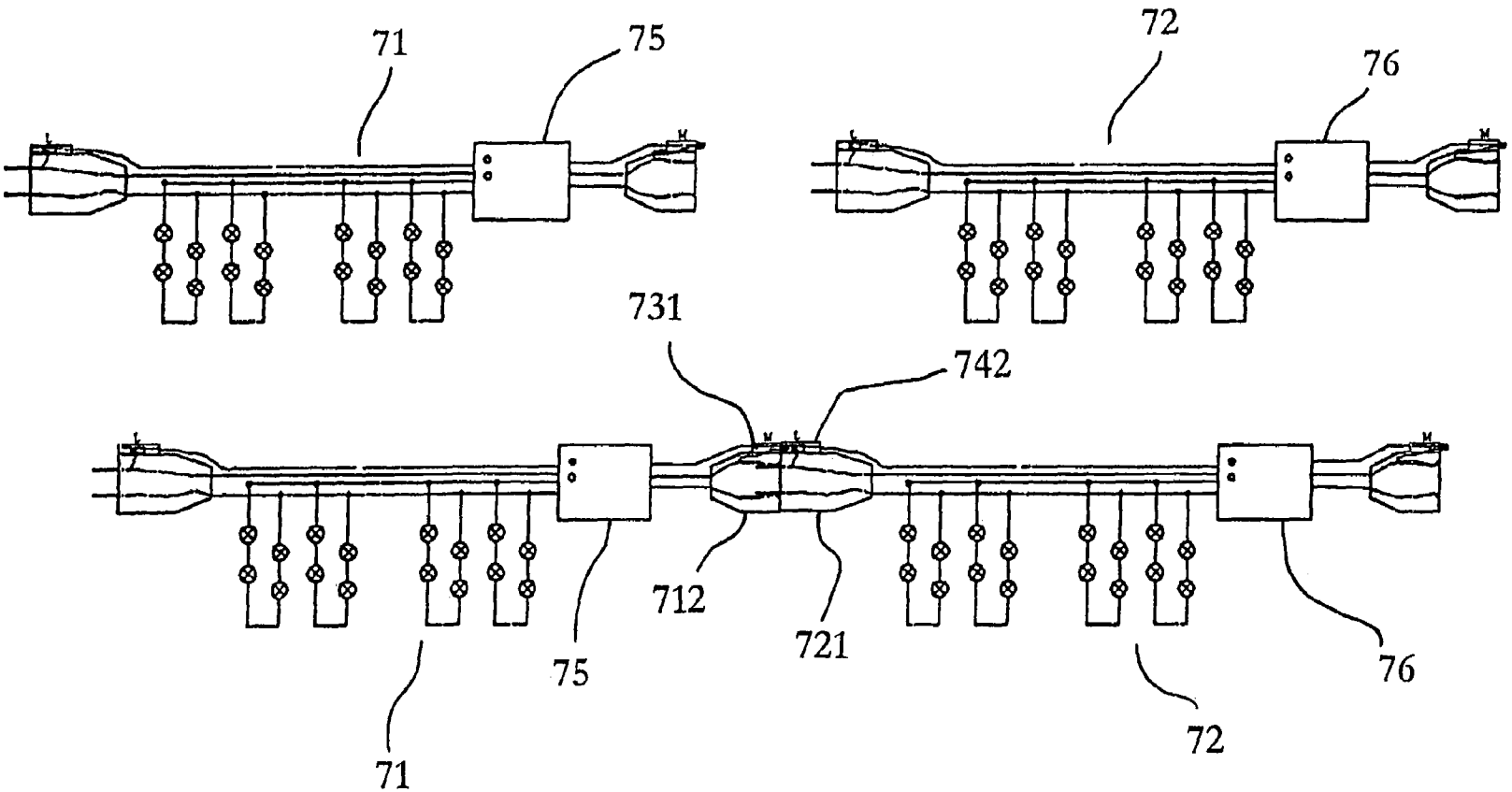
FIG. 3 is a schematic view showing the third embodiment of the serial lamp set of present invention.

As shown in FIG. 2 and FIG. 3, the serial lamp set having security warning functions of present invention can be formed by serially connecting numerous units of serial lamp sets having security warning functions. Each of the unit of serial lamp set having security warning functions 3 has a serial lamp set 4 and an IC set 5, the numerous units of serial lamp sets having security warning functions 3 can be as shown in FIG. 3, connected in series with each other to form huge animals, tall Christmas trees, high buildings, etc. The serial lamp set having security warning functions 4 of the unit of serial lamp set having security warning functions 3 also formed by connecting a plurality of light emitting elements 401,402,403,404, . . . , in series or in parallel. Wherein, the light emitting elements 401, 402, 403, 404, . . . are connected with insulated electric wire 41, while one end of the serial lamp set is installed with a power connector having a power receiver and a power supply.

The IC set 5 of each unit of serial lamp set having security warning functions 3 is also connected to the serial lamp set 4, it also has the functions of receiving the signal of electric power, generating pre-determined functions, having set limitation values of electric properties, emitting signals, such as a warning signal, and having set security warning functions.

When the numerous serial lamp sets are connected to electric power, its IC set 5 then receives the total electric properties of the numerous serial lamp sets, and when the total electric properties of the serial lamps sets exceeds the pre-limited value, a warning signal will be released and the signal will be transmitted to each serial lamp set and then to be emitted simultaneously.

The light emitting elements 401, 402, 403, 404, . . . can be light bubbles or LED lamps, the light emitting elements 401, 402, 403, . . . also can be installed onto kinds of sockets or lamp seats.

The front end of the power source connector is a power supply 42 in the form of a plug to be connected to power source, the rear end of the power source connector is a power receiver 421 to connect with the serial lamp set.

The upper end of said power supply 42 is installed with a signal sensor 43, it is preferably a CDS photo sensitive resistor and is connected with point "A" of IC set 5 by signal transmitting wire 45; the signal sensor 43 can receive and detect the condition of the power source receiving end, then the signal is emitted and transmitted to the IC set 5, after the IC set 5 identifies the current load condition, the current load condition will be shown on the housing of the IC set 5.

The IC set 5 composes a plurality of IC chips, resistors, capacitors, diodes, connection terminals, pc board and insulation housing. On the insulation housing, there is an alarm part 51 to be displayed by the LED lamp, when the electric alarm signal is emitted, the insulated electric wire transmits the signal to the rear power source receiver 421, and then displays the warning conditions at the alarm part 51. Similarly, when the green LED is lightened, it shows that the serial lamp sets are in safe condition, if the red LED is lightened, it shows that at least one of the serial lamp sets is in unsafe condition (that is, the load is over preset limitation value of electric property).

The power receiver 421 is installed at the other end of IC set 5 by connection of insulated electric wire 61 between them. There is a signal generator 46 installed at the upper end of the power receiver 421, the signal generator 46 is connected with point D of IC set 5 by a signal transmitting wire 62; when the power supply 42 connects power source, and if the load of the serial lamp set exceeds the preset limitation value of electric property, then the preset security warning is emitted.

It is then understandable that by the above shown construction, as shown in FIG. 3, the serial lamp units with the same or different specifications can be connected together, when the first serial lamp unit 71 having security warning functions and the second serial lamp unit 72 having security warning functions are connected together by connecting their power supply 721 and power receiver 712, their installed signal sensor 731 and signal generator 742 have to match each other, and after the numerous sets of power supply and power receiver are formed, when the first serial lamp set unit having security warning functions 71 connects to a power source, its IC set 75 then detects the load of total electric properties, and compares the load with the preset limitation value of electric properties, so as to display its security conditions. The detect conditions from the first serial lamp unit 71 having security warning functions is then transmitted to the serial lamp unit 76 having security warning functions connected at the rear end of the first serial lamp unit 71. And all of the warning functions are in operation, the security of numerous serial lamp set units are then confirmed.

Figure 4:
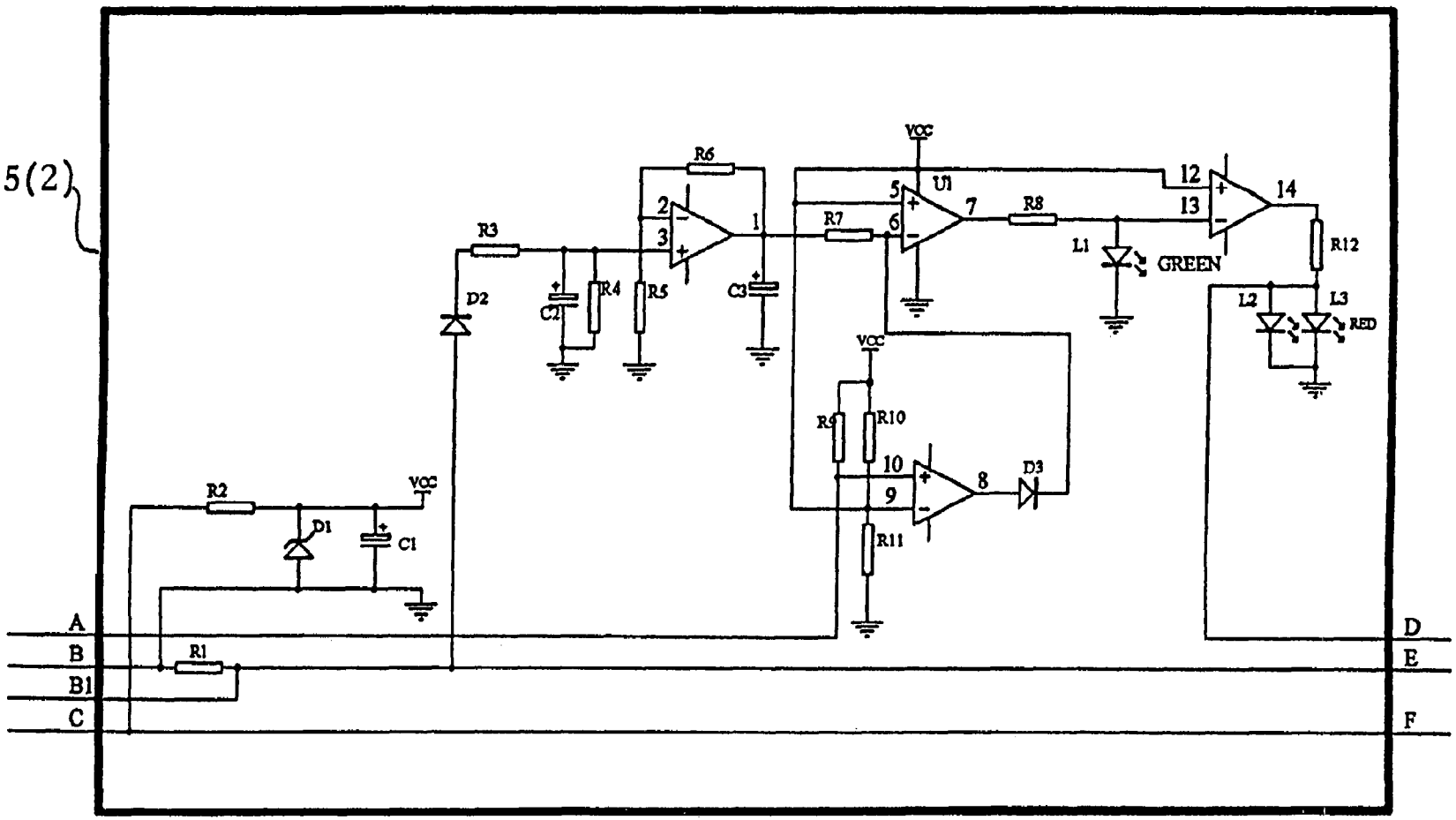
FIG. 4 is the electric circuit of the Integrated Circuit (IC) set of present invention.

As shown in FIG. 4, current flows in resistor R1 of the IC set of the present invention is connected to the change of voltage, after the voltage is modified and amplified by amplifier U1, then it is compared with preset voltage and output red lamp or green lamp, if the displayed light is green, then the current flow is still in the range of safety, one more serial lamp set can be used. If the displayed light is red, then the current flow is over the range of safety, some serial lamp sets have to be removed until the green lamp is lit.

The IC set connects the serial lamp set unit with the lead ends of B1 and C, the signal sensor of power supply with the lead ends of A and B, the signal generator of power receiver with the lead ends of D and E, the power supply with the lead ends of B and C, and the power receiver with the lead ends of E and F.

When the signal sensor detects the current flow, then a signal is transmitted to the signal generator, and if the current amplified by comparator is output at high voltage, then the green LED L1 is kept on at a normal lightening condition; if the current is output at low voltage, then the green LED L1 does not operate, the red LED of L2 and L3 is lit.

When numerous serial lamp set units are connected together with the power source, the first signal sensor will detect the current flow of all of the connected serial lamp set units, if the current exceeds the pre-limited value, then the red lamp is lit. When the next serial lamp set unit detects the former red lamp, its red lamp will also be lit. When every serial lamp set unit displays a red light, then it is deemed that the current of the serial lamp set exceeds the pre-limited value.

Therefore, the serial lamp set having security warning functions of present invention is able to detect the load condition of serial lamp set, when the serial lamp set is in use and the power source is connected. It also can show the load condition of the serial lamp set via the alarm part 21 of IC set immediately. The displayed signal of present invention cannot only be a visible signal, but also can be audible signal, such as music sounds or buzz. The outside of alarm part can be installed with a convex lens, so as to magnify the light signal and improve its function.

Under the above shown condition, the use of serial lamp set is not only limited to professional people, but the common person can make sure the safe operational condition of the serial lamp set by the present invention. It not only increases the popular application, but also increases the safety of uses. Moreover, it decreases the damage of light emitting element of serial lamp set and avoids the waste of natural resources. The most important thing is it can reduce the damage or hurt to people using the serial lamp set.

While specific embodiments of the invention have been shown and described in detail to illustrate the application of the principles of the invention, it will be understood that the invention may be embodied otherwise without departing from such principles.

What is claimed is:

1. A serial lamp set having security warning functions comprising:

a plurality of serial lamp set units connected in series, or in parallel, or in parallel-series, each serial lamp set unit including a plurality of light emitting elements, insulated electric wires, a power source receiver having a signal generator and a power supply having a signal sensor; and a plurality of integrated circuit (IC) sets, at least one IC set being connected to said serial lamp set unit, said plurality of serial lamp units being connected to a power source, each said IC set receiving an electric power signal, each said IC set having set limitation values of electric properties and having set security warning functions, said plurality of IC sets receiving the total load of said plurality of serial lamp set units, each IC set emitting a warning signal when the total load of said plurality of serial lamp sets exceeds one of said electric property limitation values, said warning signal being transmitted to the signal sensor of said power supply, whereby an alarm signal is emitted by each serial lamp set unit simultaneously.

2. The serial lamp set having security warning functions as claimed in claim 1, wherein said light emitting elements are light bubbles, or LED lamps.

3. The serial lamp set having security warning functions as claimed in claim 1, wherein said light emitting elements are installed onto kinds of sockets or lamp seats.

4. The serial lamp set having security warning functions as claimed in claim 1, wherein one end of said power source connector is a power supply, the other end is a power source receiver.

5. The serial lamp set having security warning functions as claimed in claim 1, wherein said signal displayer is a LED lamp, said LED lamp turning red to indicate an unsafe condition.

6. The serial lamp set having security warning functions as claimed in claim 1, wherein said power source forms together with said IC set without connection of insulated electric wire.

7. The serial lamp set having security warning functions as claimed in claim 1, wherein said IC set composes a plurality of IC chips, resistors, capacitors, diodes, connection terminals, pc board and insulated housing.

8. The serial lamp set having security warning functions as claimed in claim 1, wherein the warning functions of said IC set is displayed on its insulated housing.

9. The serial lamp set having security warning functions as claimed in claim 1, wherein said warning functions are displayed by LED lamp having a red light and a green light, said green light indicating a safe condition, said red light indicating an unsafe condition.

10. The serial lamp set having security warning functions as claimed in claim 1, wherein said signal sensor is connected with said IC set by insulated electric wire to receive and detect the condition of power receiving end, said condition of said power receiving end being displayed on the housing of said IC set.

11. The serial lamp set having security warning functions as claimed in claim 1, wherein said signal sensor is a CDS photo-sensitive resistor.

12. The serial lamp set having security warning functions as claimed in claim 1, wherein said signal is installed inside the power supply to prevent outside interference.

13. The serial lamp set having security warning functions as claimed in claim 1, wherein after said power supply is connected with power source receiver, the signal sensor installed at power supply matches with signal generator correspondingly.

14. The serial lamp set having security warning functions as claimed in claim 1, wherein after the numerous sets of power supply and power receiver are formed, when the first serial lamp set unit having security warning functions connects to power source, its IC set then detects the load of total electric properties, and compare the load with the preset limitation value of electric properties, so as to display its security conditions.

15. The serial lamp set having security warning functions as claimed in claim 14, wherein the detect conditions from the first serial lamp unit having security warning functions is then transmitted to the serial lamp unit having security warning functions connected at the rear end of said first serial lamp unit, and all of the warning functions are in operation, the security of numerous serial lamp sets are then confirmed.

16. A serial lamp set having security warning functions, comprising:

a plurality of serial lamp set units connected in series, or in parallel, or in parallel-series, each serial lamp unit having a plurality of light emitting elements, insulated electric wires, a power source receiver having a signal generator and a power supply having a signal sensor; and a plurality of integrated circuit (IC) sets, at least one IC set being connected to said serial lamp set unit, said plurality of serial lamp set units being connected to a power source, each of IC set receiving an electric power signal, each IC set having set electric property limitation values and having set security warning functions, said IC sets receiving the total electric properties of said plurality of serial lamp set units, each IC set emitting a warning signal when the total electric properties of said plurality of serial lamp sets exceeds one of said electric property limitation values, said warning signal being transmitted to said signal sensor of said power supply.

* * * * *